US005314016A

United States Patent [19]

Dunham

[11] Patent Number: 5,314,016

[45] Date of Patent: May 24, 1994

[54] METHOD FOR CONTROLLING ROD-PUMPED WELLS

[75] Inventor: Cleon L. Dunham, Houston, Tex.

[73] Assignee: Shell Oil Company, Houston, Tex.

[21] Appl. No.: 64,603

[22] Filed: May 19, 1993

[51] Int. Cl.[5] ..... E21B 43/00; F04B 49/02; F04B 49/06

[52] U.S. Cl. ..... 166/250; 73/151; 166/53; 166/68; 166/369; 417/12; 417/53

[58] Field of Search ..... 166/250, 369, 370, 64, 166/68, 68.5, 53; 417/12, 53, 44; 73/151

[56] References Cited

U.S. PATENT DOCUMENTS 3,930,752 1/1976 Douglas ..... 417/12
3,936,231 2/1976 Douglas ..... 417/12
3,951,209 4/1976 Gibbs ..... 166/250
4,015,469 4/1977 Womack et al. ..... 73/151
4,057,055 3/1985 Fair et al. ..... 417/12
4,286,925 9/1981 Standish ..... 417/12
4,487,061 12/1984 McTamaney et al. ..... 73/151
4,509,901 4/1985 McTamaney et al. ..... 417/18
4,541,274 9/1985 Purcupile ..... 73/151
4,583,915 4/1986 Montgomery et al. ..... 417/26
5,064,349 11/1991 Turner et al. ..... 417/53

*Primary Examiner*—Stephen J. Novosad

[57] ABSTRACT

A method for controlling a rod pumped well to limit the amount of time the pumping system is subject to fluid pound. The method monitors various pumping system parameters and shuts the pumping system down just before pump-off occurs.

7 Claims, 2 Drawing Sheets

METHOD FOR CONTROLLING ROD-PUMPED WELLS

BACKGROUND OF THE INVENTION

The present invention relates to a method for controlling a rod-pumped well to minimize the damage to the pumping unit that results from operation of the unit after the well has pumped-off. The term 'pumped-off' is used to describe the condition wherein the downhole pump barrel does not completely fill with fluid on the upstroke of the pumping unit. When this condition occurs, the rod string which is used to reciprocate the plunger in the downhole pump unit, moves down on the succeeding downstroke until the plunger contacts fluid. When the plunger contacts the fluid, vibrations and other stresses are induced in the rod string and the remainder of the pumping unit that may cause severe damage. This condition is commonly referred to as "fluid pound".

PRIOR ART

Various types of controllers have been developed for shutting down the pumping unit upon the occurrence of a pumped-off condition. These controllers all measure some parameter of the pumping unit and then monitor changes in this parameter to detect when the well has pumped-off. For example, U.S. Pat. No. 3,951,209 describes a method for controlling a pumping unit in which the load and position of the rod string are measured. The two measurements are then used to integrate the area of the load versus displacement curve to obtain a measurement of the work done by the pumping unit on a complete stroke of the unit. The area is monitored until it decreases. That decrease in area is used as an indication of a pumped-off condition and the pumping unit may be stopped temporarily to avoid fluid pound.

U.S. Pat. No. 4,015,469 describes an improvement of this patent in which only a portion of the total area of the load versus displacement is measured. The area selected is the top portion of the stroke that corresponds to the portion of the stroke during which pump-off occurs This provides a more accurate measurement of the occurrence of pump-off.

U.S. Pat. No. 4,286,925 describes a pump-off controller in which the load on the rod string at a particular position in the top of the downstroke is monitored to detect pump-off. When pump-off occurs, the load on the rod string increases as a result of the rods carrying the weight of the fluid part way down into the downstroke, until the traveling valve at the pump opens and the fluid load is transferred to the standing valve which is connected to the tubing. Thus, the increase in rod load can be used to detect pump-off.

While all of the above systems have been successful in detecting pump-off, they all require that the pumping unit actually pump-off. This causes the rod string to be subjected to the shock of the plunger in the pump falling until it contacts the fluid in the pump barrel. This condition is magnified in that all of the systems require at least two or more complete strokes of the pumping unit during which the controller detects the pumped-off condition before stopping the pumping unit. This is done to ensure that the pumping unit is not shut down in response to spurious signals or other abnormalities in the control system. These additional strokes of the pumping unit after the well has pumped-off produce considerable fluid pound in the unit.

The magnitude of the problem can be readily appreciated when it is considered that the average well may cycle 25 times per day. If one were to assume that there are four strokes of fluid pounding per cycle of the pumping unit, this would equate to 100 fluid pound strokes per day or 36,500 fluid pound strokes per year. Thus, even though the pump-off controllers of the prior art reduce the number of fluid pound strokes to which the pumping unit is subjected, it is still a large number and may cause increased damage to the pumping unit, resulting in costly maintenance.

One method that has been used to reduce the number of fluid pound strokes that occur in a pumping unit is to increase the idle time of the pumping unit and thus decrease the number of pumping cycles per day of the unit. While this decreases the number of fluid pound strokes, it also decreases the production from the well. This can be readily appreciated when one considers that the drive mechanism causing the crude oil to flow into the well is of limited capacity and once it raises the fluid level in the well to a certain level, any additional increase in the fluid level will be small.

Another method for decreasing the number of fluid pound strokes is to decrease the size of the pumping unit to the point where the well cannot pump-off. While this eliminates fluid pound, it decreases the production.

SUMMARY OF THE INVENTION

The present invention solves the above problems by providing a controller that shuts down the pumping unit before it actually pumps-off. In particular, the controller attempts to shut down the pumping unit when it has almost pumped-off the well. While this may decrease the overall production from the well by a slight amount, the amount of lost production per pumping cycle can be regained by increasing the number of pumping cycles of the well. Since the fluid pounding of the well is substantially eliminated, the overall damage to the pumping unit is also reduced while the production will remain the same or can actually be increased slightly.

The invention utilizes either the time the pumping unit has been running to control the shutdown of the unit or measures the area of the surface pump card to detect an increase in the work done by the pumping unit that occurs just prior to pump-off. Regardless of which of the two methods is used to control the pumping unit, the controller, on a periodic basis, for example once per day, allows the pumping unit to completely pump-off the well as done in the prior art devices. This is used to determine a base parameter of either run time for the pumping unit or area of the pump card for determining the work done by the pumping unit. While the pumping-off of the well will cause fluid pound, it occurs only once per day and in the average well the fluid pound of the pumping unit will be limited to only 4% or 1/25th of that which occurs when using a prior art pump-off controller.

DESCRIPTION OF THE PREFERRED EMBODIMENTS

Figure 1:
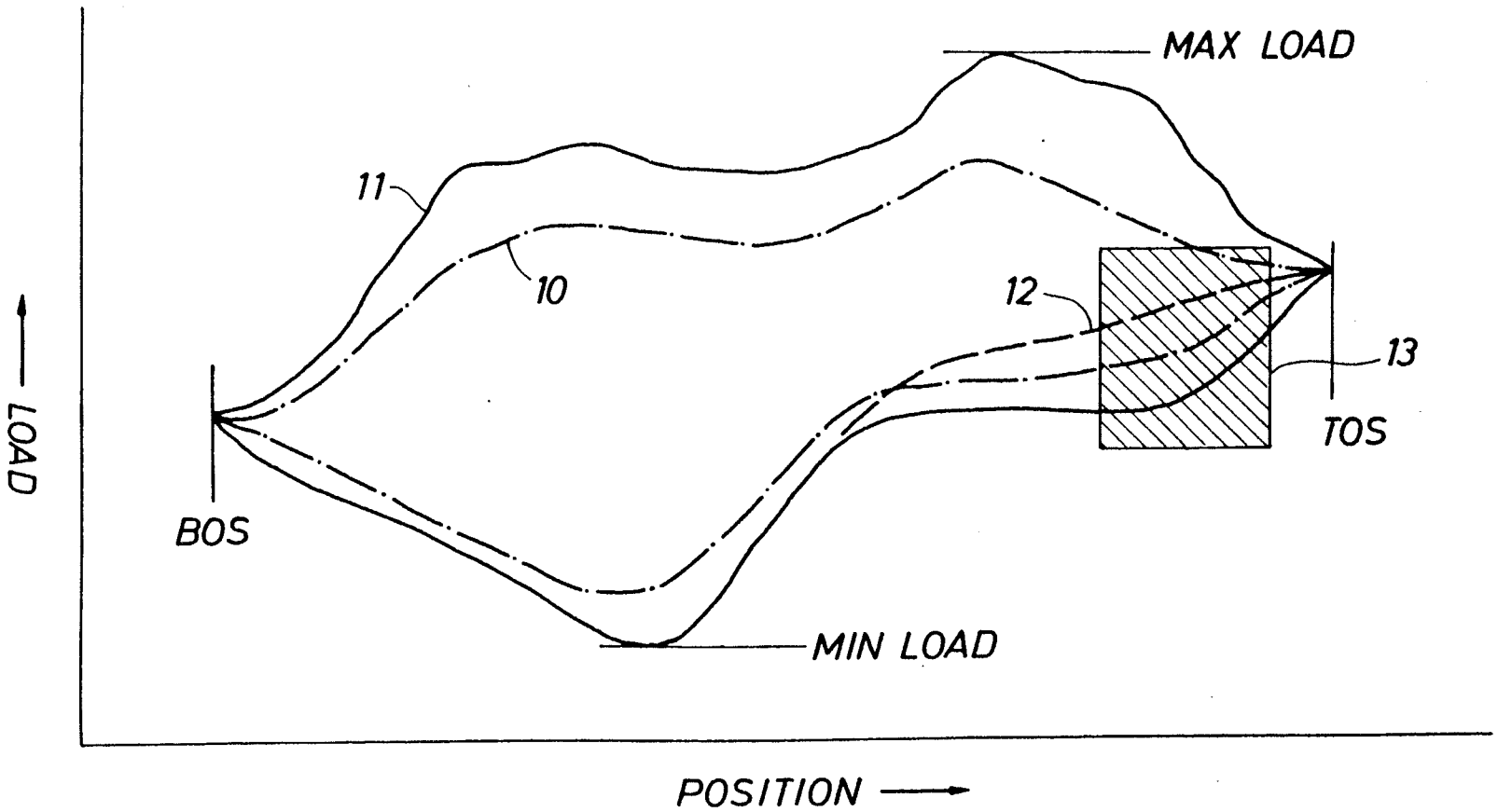
FIG. 1 shows a surface pump card having both a startup condition and a pumped-off condition.

Referring now to FIG. I, there is shown a surface pump card which is a plot of the load on the rod string versus the position of the rod string. Also shown there are the bottom of the stroke, indicated as BOS, top of the stroke, indicated as TOS, and the Maximum (Max) and Minimum (Min) load. The curve 10 illustrates the pump card at the start of the pumping cycle while the curve 11 indicates the pump card immediately, or a short time before pump-off occurs.

It can be readily appreciated that during the interval when the pump unit is shut down, the fluid level in the well annulus rises above the downhole pump as a result of continuing inflow from the producing formation. When the pumping cycle starts, the amount of work the pumping unit must perform to pump the well is reduced as a result of the reduced net height the pumping unit must lift the production fluid. As the pumping unit operates, the fluid level in the annulus drops and increases the net height the pumping unit must lift the fluid. This continues up to the point of pump-off at which point the amount of work decreases, especially in the initial portion of the downstroke of the pumping unit. This decrease is illustrated by the line 12 in FIG. 1. The decrease in work performed by the pumping unit is the result of the rods carrying the weight of the fluid part way into the downstroke until the traveling valve opens and the fluid load is transferred to the standing valve. This increases the load on the rods and reduces the energy required to reciprocate the rods. All of the prior art patents referred to above rely on the pumping unit reaching the pumped-off condition illustrated by the curve 12 before the pumping unit is shut down. Regardless of the method used to detect pump-off, i.e., monitoring the area of the pump card or monitoring the load on the rod at particular position of the rod, they all require a substantial change in either the area or rod load to detect pump-off. In addition, as explained, all the prior art units require two to three additional strokes of the pumping unit after pump-off has been detected to ensure that the initial detecting of pump-off was not the result of an erroneous measurement of load or position or some other abnormality in the control circuit. The net result of this is 3 to 5 strokes of fluid pound before the pumping unit is stopped.

The present invention monitors the area of the pump card and detects the area illustrated by the curve 11 that occurs immediately preceding pump-off of the well. As explained above, the invention allows the well to actually pump-off as illustrated by the curve 12 on some periodic schedule, preferably once each day or less often in some cases. This allows the controller to reprogram the point at which the pumping unit is shut down to compensate for any small changes that occur over time in the pumping unit or production from the well.

In some wells under some conditions, i.e., high water to oil ratios, the water and oil in the annulus will separate when the pump unit is shut down. When the pump unit is started it will initially produce substantially all water. The normal inflow of oil and water to the well will be small compared to the volume of fluid in the annulus and substantially only water will be produced. As explained above the high fluid level in the annulus will reduce the work done by the pump to lift the fluid. This is commonly referred to as the U-tube effect. As the fluid level falls the work required to lift the fluid will increase because of the reduced U-tube effect. When the oil level in the annulus reaches the pump the work required will tend to remain constant. This results from the lower gravity of the oil compared to water partially offsetting the reduced U-tube effect as a result of the falling fluid level in the annulus. If sufficient oil is present in the annulus, it is possible for the oil to completely displace the water in the production tubing in the well. If this occurs it is possible that the work required to lift the fluid will actually be reduced below previous levels. This will result in work levels that indicate an almost pumped-off condition occurring at two separate times in the pump cycle.

The pump-off control of the present invention can be programmed to handle the above condition. This is accomplished by using occurrence of the first work level as an indicator of an almost pumped-off condition. When the almost pumped-off condition is detected an additional run time $\Delta T$ is added to the run cycle of the pump unit. The value of $\Delta T$ can be set by an operator or the control can be programmed to set it by allowing the well to periodically pump-off.

Once the unit has been allowed to pump-off, the controller can be set either to control the actual run time of the pumping unit or measure the area of the surface pump card and shut the pumping unit down when the area is slightly less than the maximum area shown by the curve 11.

As explained above, when the pumping unit first starts after a shutdown period, the surface pump card will have a reduced area represented by curve 10 of FIG. 1. This area will gradually increase as the fluid level in the well annulus falls and more work is required to lift the fluid from the well. This increased work is represented by an increase in the area of the surface card and will continue until the well pumps-off when it will decrease. Thus, the pump-off limit can be set at some selected area below the maximum area that occurs immediately before pump-off.

Figure 2:
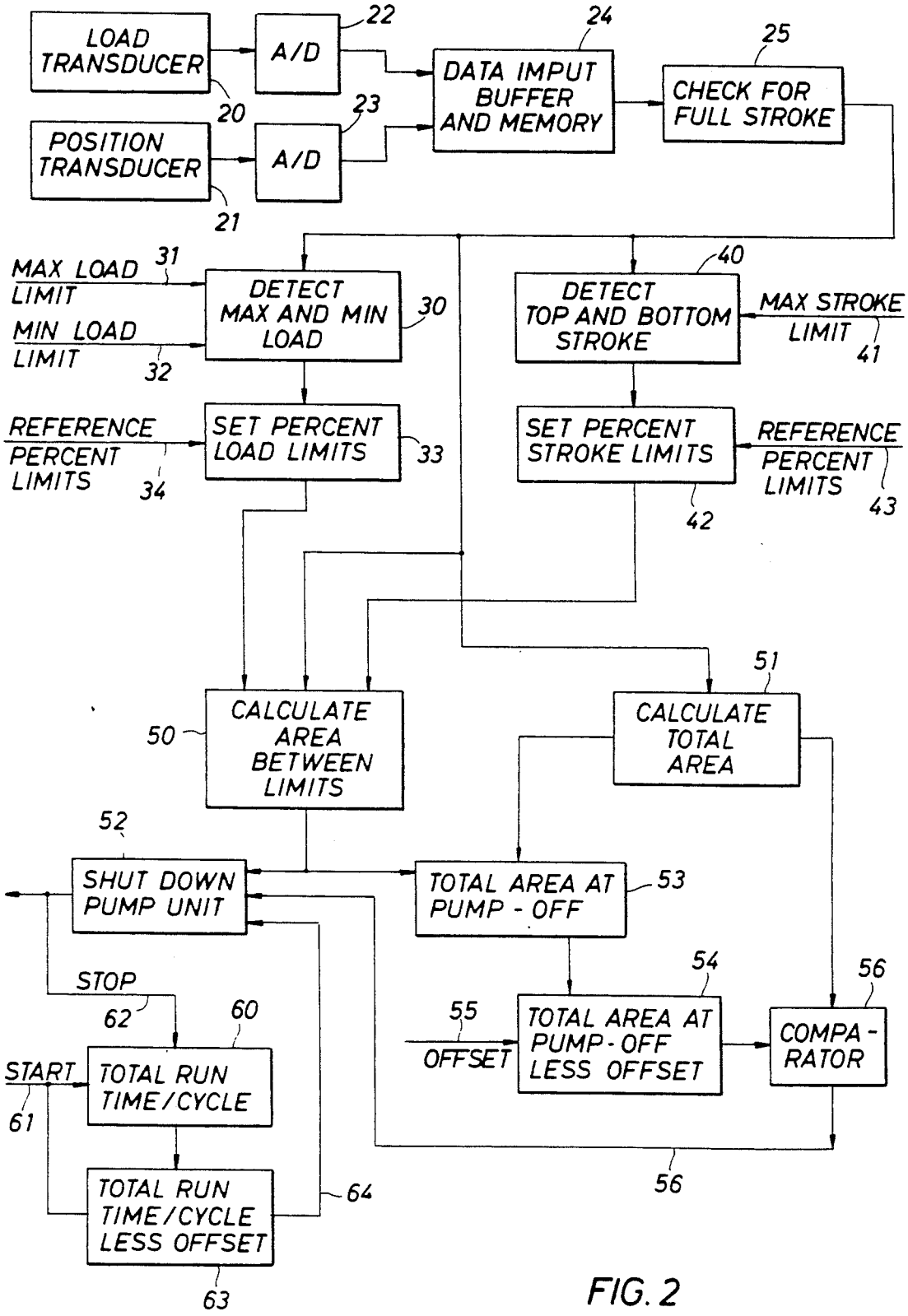
FIG. 2 is a block diagram of a circuit suitable for performing the method of the present invention.

Referring now to FIG. 2, there is shown a block diagram of the calculations required for the present method. The majority of the calculations shown in FIG. 2 are accomplished by programming a microprocessor-based remote terminal unit manufactured by Automation Electronics Inc., Casper, Wyo., and referred to as a Model 6008 SX Remote Terminal Unit. Other manufacturers also offer remote terminal units, for example Baker-Hughes Co. of Houston, Tex., that can be programmed to perform the calculations of the present invention. This unit has provisions for both utilizing an E-PROM which has been preprogrammed to perform various functions and provisions for allowing an operator to use an external keyboard to program various functions and set various limits. In addition to the remote terminal unit, a load transducer and a position transducer are mounted on the pumping unit to measure the load on the rod string and the position of the rod string. Both of these measurements are normally analog measurements and they are supplied to A/D converters 22 and 23 to be converted to a digital form. The output from the A/D converters are supplied to a data input buffer and memory 24 that accumulates the data points relating to a complete stroke of the pumping unit. In addition, the load data points are correlated with the position data points and both measurements are collected in a memory 25 to determine if a complete stroke of data has been obtained. Once the complete stroke of data has been obtained, it is supplied to the remainder of the system.

The microprocessor is programmed to detect the maximum and minimum (max and min) loads 30 on the rod string and determines if either the maximum load limit or minimum load limit have been exceeded. The maximum and minimum load limits 31 and 32 are set by the operator using a key pad input as explained above. If either limit has been exceeded, the microprocessor will actuate circuits to shut the pumping unit down in response to the violation of the load limits. The load and position data is used to calculate the percentage load limits in response to the reference limits 34 set by the operator. The data from the complete stroke is also used to detect the top and bottom of the stroke 40 and ascertain if any violations of the maximum stroke limit have occurred. The maximum stroke limit is preset by a reference 41 by the operator using a key pad. The data is also used to calculate percentage stroke limits 42 in response to the preset reference limits 43 entered by the operator. The percentage load limits and percentage stroke limits are used to calculate an area between the two load limits and two stroke limits to detect when the well has pumped-off. The area defined by percentage load and percentage stroke limits is normally located in the area of the pump card at the top of the stroke as shown by the crosshatched area 13 in FIG. 1. The output from the pump-off controller 50 is used to actuate the shutdown circuit 52 when pump-off occurs to stop the pumping unit.

The load and position data for a complete stroke is also used to calculate the total area of the surface pump card 51. The total area at pump-off is determined by using the pump-off signal to store the total area in the memory of circuit 53 as a reference. The almost pumped-off area is set by the operator as a reference input 55, or in the alternative, the reference input 55 can be programmed as some percentage of total area at pump-off. A time delay $\Delta T$, as described above, is incorporated in the system. Thus, the actual shut down of the pumping unit occurs a time delay $\Delta T$ after the system detects the almost pumped-off area. Since most rod-pumped wells produce some water in addition to oil this ensures that the pumping unit is not shut down in response to a premature or false detection of an almost pumped-off area. If the well actually pumps-off prior to the elapse of $\Delta T$, the $\Delta T$ can be reduced. In addition as described above at some regular interval, for example, once a day the well should be allowed to pump-off and both the almost pumped-off area and the $\Delta T$ reset.

Similarly, the total run time of a pump cycle can be accumulated and used to control the operation of the pumping unit. In this case, a circuit 60 would be started by an input signal 61 that is received from the circuit controlling the starting and stopping of the pumping unit. Also, a signal 62, which would be a stop signal received from the shutdown unit 52. Thus, the circuit would calculate the total run time for any particular cycle of the pumping unit. In particular, the circuit would select a run time for shutting down the pumping unit upon pump-off as determined by the circuit 50. This signal could then be supplied to a circuit 63 which would take the total run time, less a selected offset, to determine the length of the pumping cycle of the unit. In this case, the circuit 63 would begin when the pumping unit is started and supply a shutdown signal over the lead 64 upon the elapse of the selected time.

From the above description it is seen that the invention controls the operation of a rod pumping unit and shuts it down before the onset of fluid pound. The control method monitors either the run time of the pumping unit or the area of the surface pump card. The control is set by allowing the well to completely pump-off on a periodic basis, i.e., once a day. The data from the complete pump-off, either total run time or area of the pump card, is then used as the base condition for the control. The base condition is adjusted for an operator-selected offset and compared to the value of the same condition in subsequent run cycles of the pumping unit. When the actual value of the condition on a subsequent cycle equals the base condition adjusted for the offset, the pumping unit is stopped. The magnitude of the offset selected by the operator is large enough to ensure that the pumping unit will be stopped before the onset of fluid pound.

The present invention has the advantage over previous control systems because it adjusts the base conditions on a periodic basis. This compensates for changes over time in either the pumping unit or the well. The invention also uses actual pump-off conditions to set the base conditions and does not rely on arbitrary values selected by the operator. This is particularly important when run time is used to control the pumping unit.

In addition to the above mode of operation, the invention can also be used to optimize the operation of the pumping unit. When it is desired to optimize the pumping unit the system is programmed to increase the $\Delta T$ a preset amount for each pumping cycle. The incremental increase per pumping cycle is limited to a value that will not cause the well to pump-off on the next pumping cycle. The process of increasing the $\Delta T$ is continued until the well pumps-off at which point the $\Delta T$ is decreased a set amount, preferably a pre-set multiple of the incremental increases. The pumping unit is then operated using $\Delta T$ that was set in response to the optimizing process. The optimizing process should be repeated at a regular interval to establish a new value for $\Delta T$. The use of the optimizing process can be used either in combination with the program for allowing the well to pump-off on a preprogrammed basis as described above or in place of the pre-program.

What is claimed is:

1. A method for controlling a rod pumped well having a pumping unit located at the surface and disposed to reciprocate the rod string, said method comprising:

a controller, said controller being disposed to monitor at least one parameter of the pumping unit;

using said at least one parameter to determine when the well has pumped-off;

stopping the pumping unit when the controller determines the well has pumped-off;

measuring the run time the pumping unit has run between starting of the pumping unit and stopping of the pumping unit in response to pump-off;

restarting said pumping unit after a predetermined time period;

stopping said pumping unit after a time period that is a predetermined percentage of the measured run time; and periodically measuring a new run time by allowing the well to pump-off and controlling the stopping of the pumping unit after a time period that is a predetermined percentage of the new measured run time.

2. A method for controlling the run time of a rod pumped well having a pumping unit located at the surface and disposed to reciprocate the rod string, said method comprising:

measuring the load and displacement of the rod string as it is reciprocated by the pumping unit;

integrating the measured load and displacement to obtain the area of the surface pump card related to the amount of work done in a pump cycle;

monitoring the integrated area to determine the magnitude of the integrated area when the well has pumped-off;

stopping the pumping unit when the well has pumped-off;

determining the total integrated area when the well has pumped-off;

setting a pump-off limit based on a measured integrated area that is a preset percentage less than the integrated area that is determined when the well pumps-off; and re-starting the pumping unit after the elapse of a preset time interval and stopping the pumping unit when the integrated area exceeds the set pump-off limit.

3. The method of claim 2 wherein said step of monitoring the integrated area to determine the magnitude of the integrated area when the well has pumped-off is repeated at preset time intervals and a new pump-off limit is set each time the step of monitoring is repeated.

4. The method of claim 2 wherein the operation of said pumping unit is continued for a preset number of cycles after the cycle in which the integrated area exceeds the preset area.

5. The method of claim 2 wherein said preset percentage is increased a preset amount each time the pumping unit is stopped until the pumping unit is stopped in response to a pumped-off condition and then reducing the preset amount until the pumping unit is stopped in response to the integrated area exceeding the pump-off limit.

6. The method of claim 1 wherein the run time is increased a preset amount for each cycle of the pumping unit until the pumping unit shuts down in response to a pumped-off condition; decreasing the run time a preset amount after the shut down in response to a pumped-off condition.

7. The method of claim 6 wherein the steps of increasing and decreasing the run time are repeated continuously.

* * * * *